US007445502B2

(12) United States Patent
Zhang

(10) Patent No.: US 7,445,502 B2
(45) Date of Patent: Nov. 4, 2008

(54) ELECTRICAL CONNECTOR WITH SHELL

(75) Inventor: George(Huanyi) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/699,279

(22) Filed: Jan. 29, 2007

(65) Prior Publication Data

US 2008/0182456 A1 Jul. 31, 2008

(51) Int. Cl.
*H01R 13/648* (2006.01)

(52) U.S. Cl. ..... 439/607; 439/733.1

(58) Field of Classification Search ..... 439/607, 439/733.1, 608–610
See application file for complete search history.

(56) References Cited

U.S. PATENT DOCUMENTS 6,059,581 A * 5/2000 Wu ..... 439/79
6,152,773 A * 11/2000 Chen ..... 439/607
6,267,624 B1 * 7/2001 Wu et al. ..... 439/607
6,322,396 B1 * 11/2001 Kuan ..... 439/607
6,379,186 B1 * 4/2002 Shi et al. ..... 439/607
6,478,623 B1 * 11/2002 Wu ..... 439/607
6,767,251 B2 * 7/2004 Yu et al. ..... 439/607
6,918,777 B2 * 7/2005 Fan ..... 439/135
7,108,554 B2 * 9/2006 Huang ..... 439/607
2003/0199197 A1 * 10/2003 Yu et al. ..... 439/607
2004/0043659 A1 * 3/2004 Lai ..... 439/607
2005/0026500 A1 * 2/2005 Ji et al. ..... 439/607
2005/0277334 A1 * 12/2005 Huang ..... 439/607
2006/0014438 A1 1/2006 Regnier
2006/0160399 A1 7/2006 Dawiedczyk et al.

* cited by examiner

*Primary Examiner*—Gary F. Paumen
(74) *Attorney, Agent, or Firm*—Wei Te Chung

(57) ABSTRACT

An electrical connector (100) includes an insulated housing (1), a number of terminals (2) arranged into two rows and received in the insulated housing respectively and a metal shell (3) pre-assembled with the insulated housing via coupling device. The insulated housing (1) comprises a front wall, a back wall, a bottom wall and a pair of lateral walls interconnecting with the front, the back and the bottom walls to define a hollow. The metal shell (3) comprises a front side, a rear side and a pair of transversal sides joining to the front and the rear sides to define a receiving space (30). The lower section of the receiving space is used for housing the insulated housing and the upper section of the receiving space is adapted for receiving the complementary connector.

19 Claims, 5 Drawing Sheets

ELECTRICAL CONNECTOR WITH SHELL

CROSS-REFERENCE TO RELATED APPLICATION

This application is related to U.S. patent application Ser. No. 11/492,148 filed on Jul. 24, 2006, invented by George (Huan Yi) Zhang, entitled "ELECTRICAL CONNECTOR WITH SHELL", which is assigned to the same assignee as this application.

BACKGROUND OF THE INVENTION

1. Field of the Invention

The present invention generally relates to an electrical connector, and more particularly to an electrical connector with a metal shell.

2. Description of Related Art

The SFF Committee is an ad hoc group formed to address storage industry needs in a prompt manner. When formed in 1990, the original goals were limited to define de facto mechanical envelopes within which disk drives can be developed to fit compact computer and other small products. A Mini SAS connector is one kind of high-speed I/O port established by the SFF Committee, and this kind of connector can transmit data up to 3 Gbps or more. Such Mini SAS receptacle connector generally has a metal shell used for guiding a plug connector and suppressing electro magnetic interference (EMI). For example, U.S. Pub. No. 2006/0160399A1 discloses a receptacle connector with a metal shell adapted for guiding the plug connector to mating with the receptacle connector. An insulated housing and the metal shell of the receptacle connector are mounted on a circuit substrate respectively. However, as the metal shell and the insulated housing are not assembled together, that is to say, the metal shell and the insulated housing are individual parts. Thus, the position between the metal shell and the insulated housing is loose and incontrollable. When the metal shell is soldered to the circuit substrate, the predetermined relative position between the metal shell and the insulated housing may be changed, thus, when the plug connector mates with the receptacle connector, the metal shell may guide the plug connector into engagement with the receptacle connector incorrectly, and the electrical connection between the plug connector and the receptacle connector may be effected.

Hence, an improved electrical connector with a metal shell is highly desired to overcome the disadvantages of the related art.

SUMMARY OF THE INVENTION

Accordingly, an object of the present invention is to provide an electrical connector with improved structures to make a complementary connector mating with the electrical connector more easily and accurately.

Another object of present invention is to provide an electrical connector with improved structures to make it easy and convenient to assemble the electrical connector to a circuit substrate.

In order to achieve the object set forth, an electrical connector in accordance with the present invention comprises an insulated housing, a plurality of terminals arranged into two rows and received in the insulated housing respectively and a metal shell pre-assembled with the insulated housing via coupling device. The insulated housing comprises a front wall, a back wall, a bottom wall and a pair of lateral walls interconnecting with the front, the back and the bottom walls to define a hollow. The metal shell comprises a front side, a rear side and a pair of transversal sides joining to the front and the rear sides to define a receiving space. The lower section of the receiving space is used for housing the insulated housing and the upper section of the receiving space is adapted for receiving the complementary connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
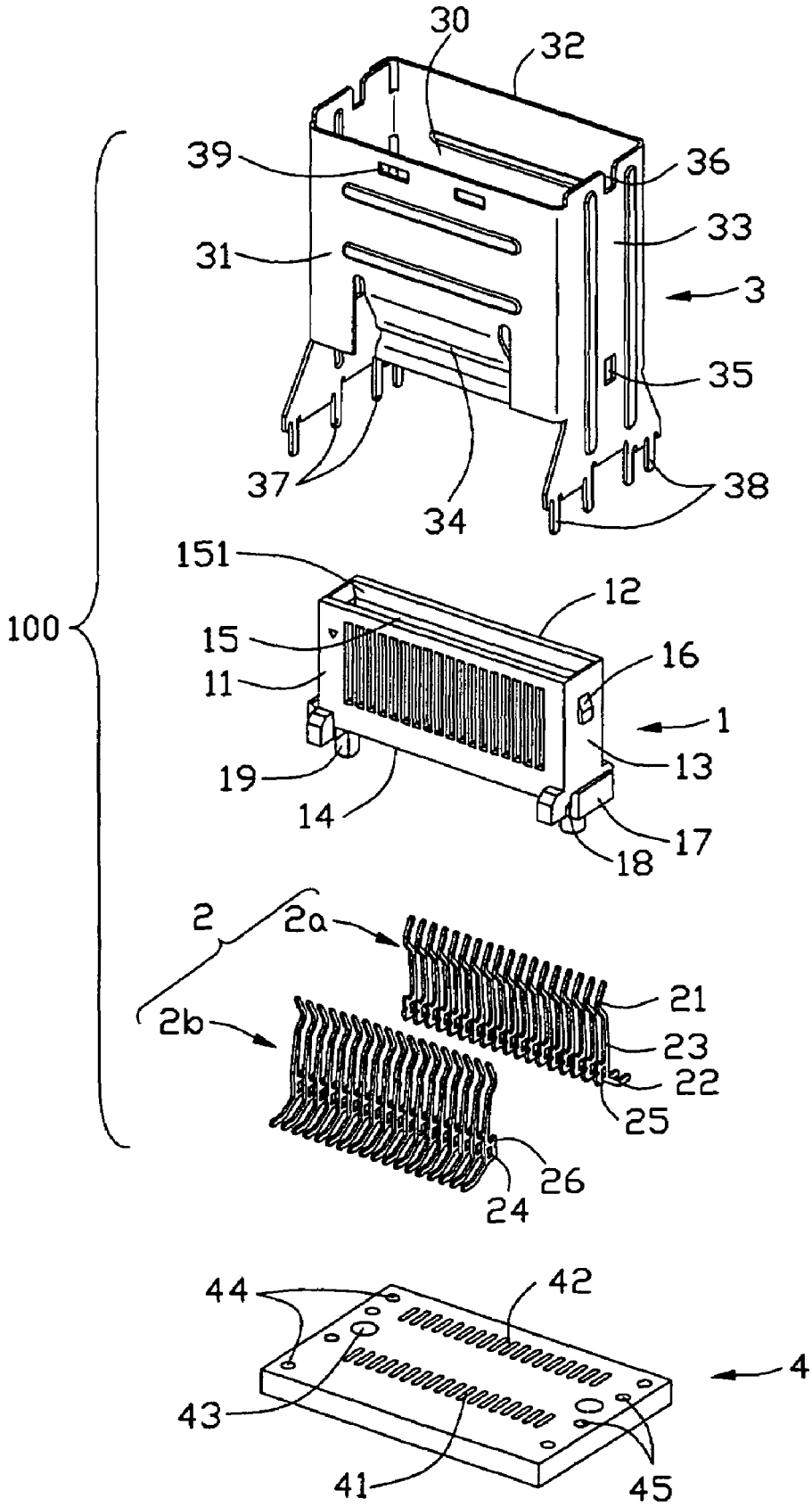
FIG. 1 is an exploded, perspective view of an electrical connector in accordance with the present invention and a circuit substrate on which the electrical connector is mounted.
Figure 2:
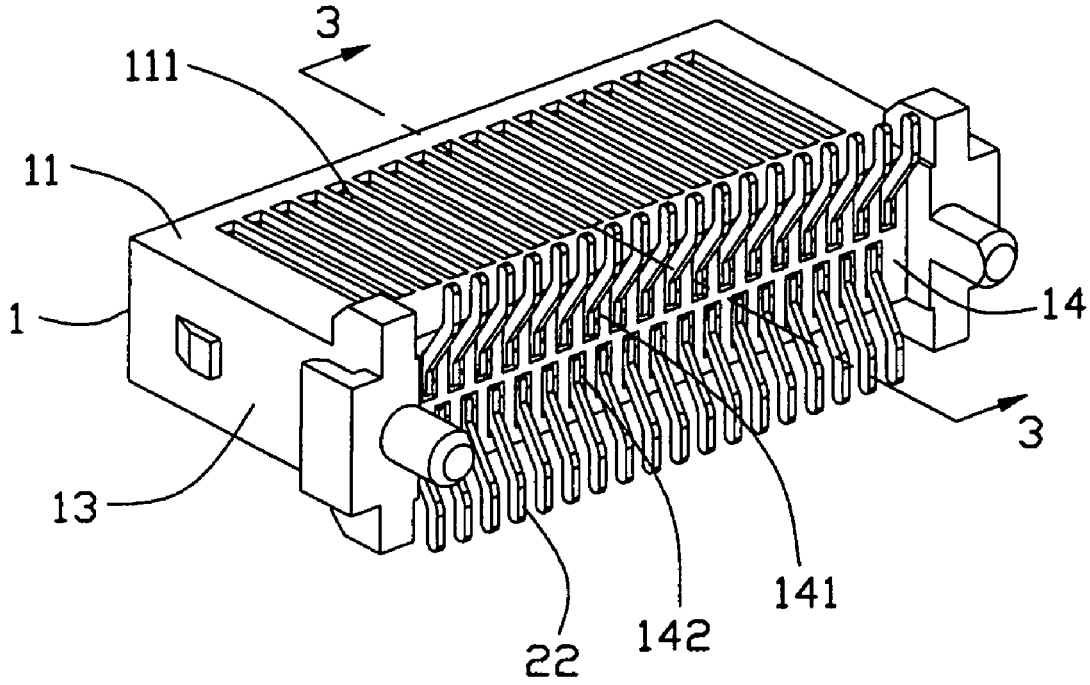
FIG. 2 is a partially assembled, perspective view of the electrical connector.
Figure 3:
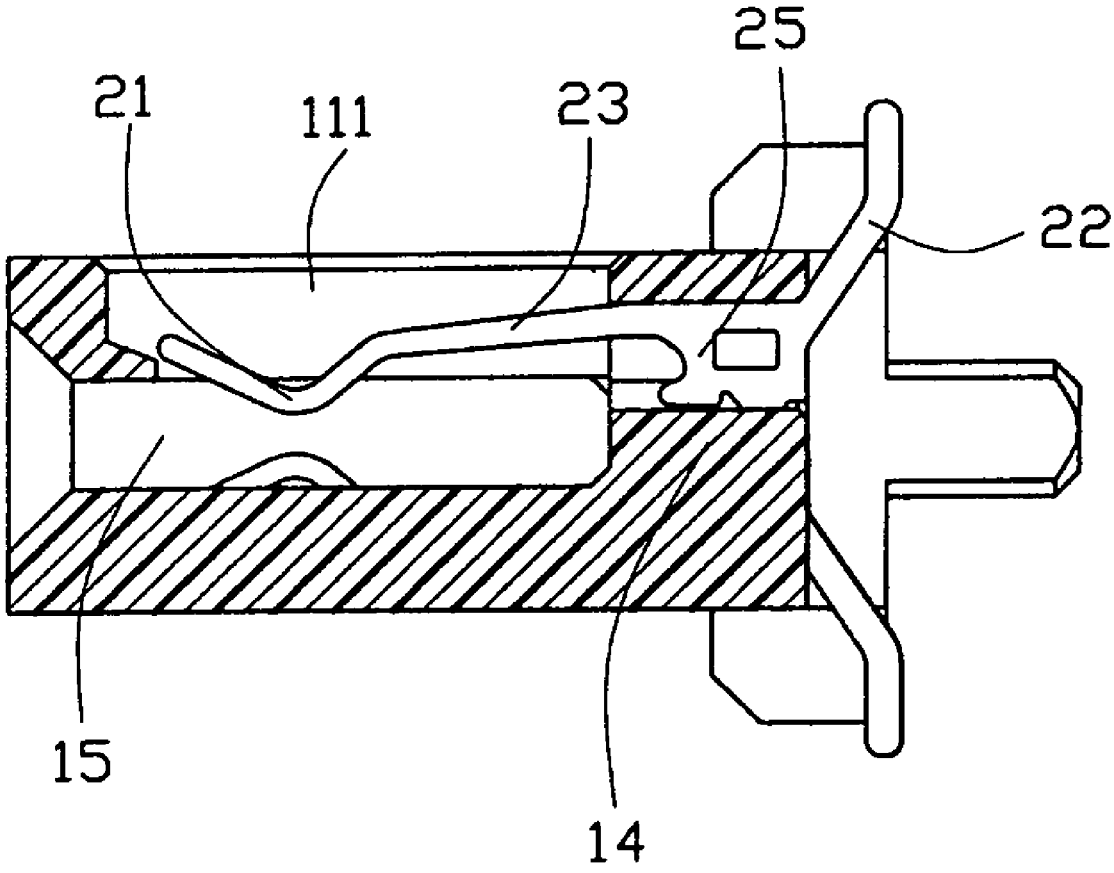
FIG. 3 is a cross-section view taken along line 3-3 of the partially assembled electrical connector as shown in FIG. 2.
Figure 4:
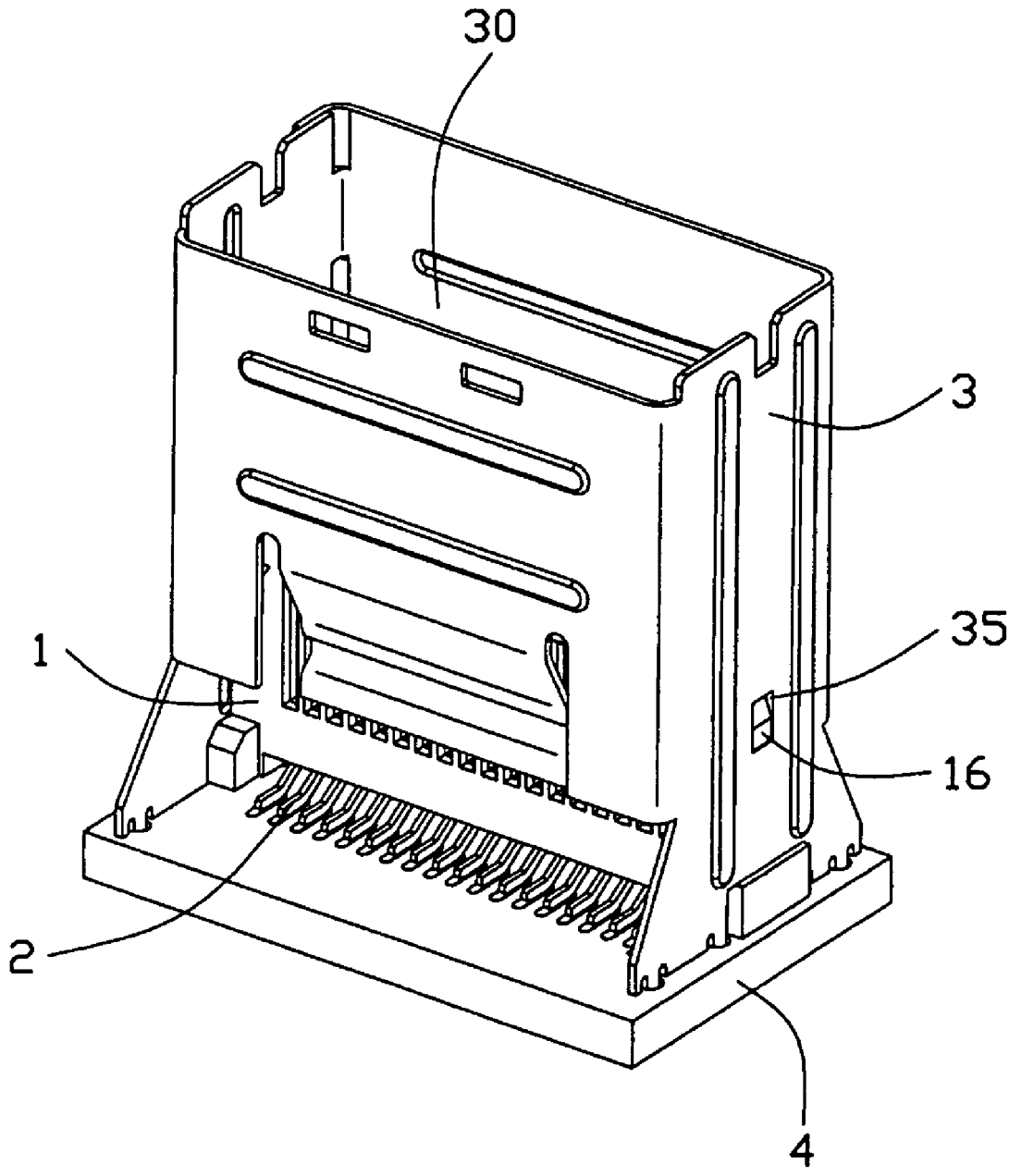
FIG. 4 is an assembled, perspective view of FIG. 1.
Figure 5:
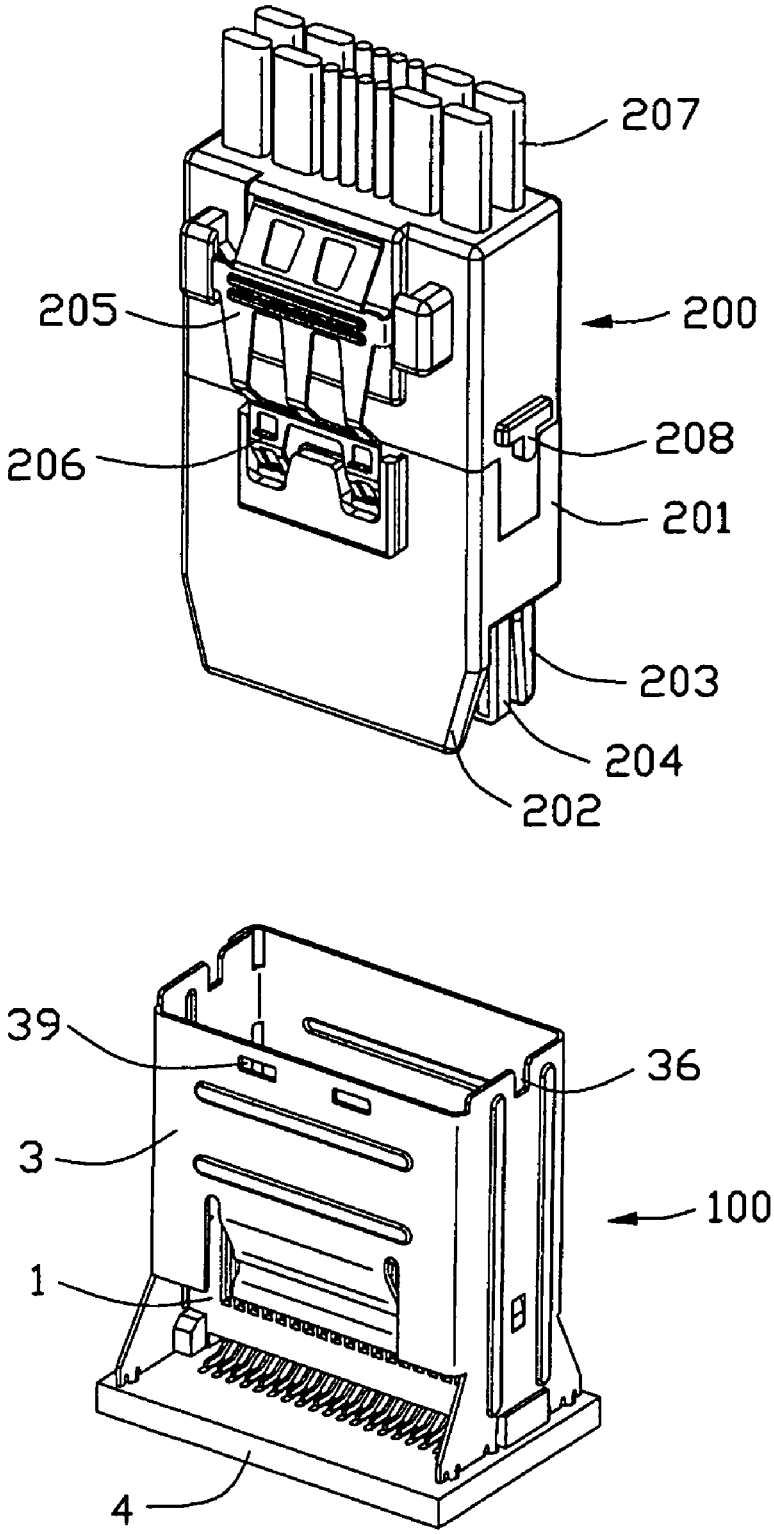
FIG. 5 is a perspective view of the electrical connector and a complementary connector.

Referring to FIG. 5, a vertical-type electrical connector 100 mounted on a circuit substrate 4 for mating with a complementary connector 200. The complementary connector 200 comprises a substantially cubic body portion 201, a first protruding member 202 and a second protruding member 203 spaced apart from each other in a parallel relationship and respectively extending downwardly from the bottom portion of the body portion 201, a printed circuit board (PCB) 204 disposed between substantially middle of the first protruding member 202 and the second protruding member 203 with its upper portion received in the body portion 201, a plurality of cables 207 electrically connecting with conductive traces (not shown) of the PCB 204 with their connecting portions overmolded within upper portion of the body portion 201, and a latch mechanism 205 assembled on the front portion of the body portion 201. The latch mechanism 205 has a pair of spring latch portions 206 used for latching with corresponding latching holes 39 of the electrical connector 100. The complementary connector 200 further comprises a pair of T-shaped alignment members 208 formed on the two sides of the body portion 201.

Referring to FIGS. 1-4, the vertical-type electrical connector 100 in accordance with the present invention comprises an insulated housing 1, a plurality of contacts 2 arranged in two rows along the horizontal direction and received in the insulated housing 1, and a metal shell 3 assembled to the insulated housing 1.

The insulated housing 1 comprises a front wall 11, a back wall 12 facing to the front wall 11, a bottom wall 14 and a pair of lateral walls 13 interconnecting with the front wall 11, the back wall 12 and the bottom wall 14 to define a hollow 15 with a top opening 151. Both the front wall 11 and the back wall 12 define a plurality of slots 111 communicating with the hollow 15. The slots 111 of either the front wall 11 or the back wall 12 are aligned in a row along a first direction perpendicular to a vertical direction. The bottom wall 14 has a plurality of passages separated into a first row of passages 141 and a second row of passages 142 disposed along horizontal direction. The first row of passages 141 are staggered apart from the second row of passages 142. Each of the first row and the second row of passages 141, 142 communicates with corresponding slot 111 in line. A wedge-shaped protruding member 16 and an L-shaped bulge 17 are respectively formed on the upper portion and the lower portion of each lateral wall 13 for assuring the blind assembly of the shell 3 to the insulated housing 1. A positioning slot 18 is defined between inner surface of the bulge 17 and the outer surface of the lateral wall 13. A pair of positioning posts 19 extend downwardly from opposite lateral sides of the bottom wall 14 for providing mechanical support for the insulated housing 1 when assembled to the circuit substrate 4.

The terminals 2 comprise a plurality of first set of terminals 2*a* and second set of terminals 2*b* arranged in two distinct sets along horizontal direction. The first set of terminals 2*a* and the second set of terminals 2*b* have same structures. Each of the first set of terminals 2*a* or the second set of terminals 2*b* comprises a vertical body portion 23, a substantially V-shaped contacting portion 21 firstly slantways extending upwardly and inwardly from the top end of the body portion 23, then slantways extending upwardly and outwardly, a rear portion 22 firstly aslant extending downwardly and outwardly from the bottom end of the body portion 23, then extending outwardly and horizontally, and a retention portion 25 extending inwardly from the lower portion of the body portion 23. The retention portion 25 defines a through hole 24 to increase impedance and a barb 26 to increase combination between the retention portion 25 and the insulated housing 1.

The metal shell 3 comprises a front side 31, a rear side 32 and a pair of transversal sides 33 joining to the front side 31 and the rear side 32 cooperatively defining a receiving space 30 for shielding the insulated housing 1. A pair of latching holes 39 are defined on the upper portion of the front wall 31 and a spring member 34 is formed at the bottom edge of the front side 31 and curved toward the rear side 32. A locking hole 35 and a cutout 36 are respectively defined on the lower portion and the upper portion of each transversal side 33. The cutout 36 communicates with the upper edge of the transversal side 33. Two pairs of inner first legs 37 and another two pairs of outer second legs 38 respectively extend downwardly from the middle and lateral bottoms of the pair of transversal sides 33.

The circuit substrate 4 has a plurality of conductive pads arranged in distinct a first set of conductive pads 41 and a second set of conductive pads 42. Two pairs of first apertures 44 and another two pairs of second apertures 45 are spaced arranged on the two sides of the circuit substrate 4 for receiving correspond first legs 37 and second legs 38. A pair of positioning holes 43 are spaced arranged between two pairs of second apertures 45.

When assembly, the first set of terminals 2*a* and the second set of terminals 2*b* are assembled to the insulated housing 1 along a first direction perpendicular to the bottom wall 14 of the insulated housing, with the contacting portions 21 exposed in the hollow 15, the body portions 23 disposed in the slots 111, the retention portions 25 inserted into the passages 141 and the barbs 26 interferentially received therein, and the rear portions 22 exposed outside of the bottom wall 14. The ends of the rear portions 22 of the first set of terminals 2*a* and the second set terminals 2*b* horizontally extend outwardly along opposing direction, respectively. As the most part of the terminals 2 are exposed in air whose dielectric constant is different from that of the insulated housing 1, thus, the property, especially the impedance of the terminals 2 is better improved. Secondly, the metal shell 3 is assembled to the insulated housing 1, with the insulated housing 1 housed in the lower section of the receiving space 30 of the metal shell 3. The bottom edge of each transversal side 33 is sandwiched by the positioning slot 18 of the insulated housing 1 and the bulge 17 is clamped by the pair of first legs 37. The locking members 16 inserted into the locking holes 35 serve as a coupling device make the insulated housing 1 and the metal shell 3 combined together firmly. The coupling device for combining the metal shell 3 and the insulated housing 1 is not limited to the locking holes 35 of the metal shell 3 latching with the protruding member 16 formed on the insulated housing 1, other coupling devices, such as spring tabs formed on the metal shell 3 combined with depression portion defined on the insulated housing 1 are also available. The protruding member 16 can lock with the locking holes 35 more easily via alignment between the pair of first legs 37 and the L-shaped bulge 17. Further more, the insulated housing 1 and the metal housing 3 can withstand much bigger force along vertical direction via the couple device, and the insulated housing 1 and the metal shell 3 can withstand much bigger force along longitudinal direction via cooperation between the pair of first leg 37 and the L-shaped bulge 17. Thirdly, the insulated housing 1 together with the metal shell 3 is mounted on the circuit substrate 4, with the positioning posts 19 inserted into the positioning holes 43, the first legs 37 and the second legs 38 inserted into the first apertures 44 and the second apertures 45, respectively, and the ends of the rear portions 22 of the first and the second set of terminals 2*a*, 2*b* disposed on the first and the second conductive pads 41, 42 of the circuit substrate 4, respectively. Fourthly, the first legs 37 and the second legs 38 are soldered to the circuit substrate 4, and the rear portions 22 of the first and second set of terminals 2*a*, 2*b* are also soldered to the conductive pads 41, 42.

When the complementary connector 200 mates with the electrical connector 100, via the leading of the metal shell 3 and the cooperation between the T-shape alignment members 208 and the cutouts 322, the lower portion of the body portion 201 of the complementary connector 200 is housed in the upper section of the receiving space 30, with the first and the second protruding members 202, 203 received in a space formed between the insulated housing 1 and front and rear sides 31, 32 of the metal shell 3; the printed circuit board 204 received in the hollow 15 of the insulated housing 1 and located between the first set of terminals 2*a* and the second set of terminals 2*b*, the conductive traces (not shown) of printed circuit board 204 electrically contacting with the mating portions 21 of the terminals 2, the latching portions 206 locking with the latching holes 39 of the metal shell 3 and the lowest portion of the spring member 34 pressing against the first protruding member 202 to prevent rotation of the complementary connector 200 relative to the electrical connector 100, thus, the engagement between the complementary connector 200 and the electrical connector 100 is more stable. As the metal shell 3 and the insulated housing 1 are fixed together, the relative position therebetween is fixed and tolerance is controlled easily in connector manufacturing process.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A vertical type electrical connector mounted on a circuit substrate adapted for mating with a complementary connector, said complementary connector comprising a body portion, a printed circuit board with its rear portion received in the lower section of the body portion, at least one protruding member spaced apart from the printed circuit board in a parallel relationship and extending from the body portion along a mating direction, comprising:

an insulated housing comprising a front wall, a back wall, a bottom wall and a pair of lateral walls interconnecting with the front, the back and the bottom walls to define a hollow adapted for receiving the printed circuit board of the complementary connector, each of lateral walls forming an L-shaped bulge at the lower portion, said L-shaped bulge and the side wall cooperatively form a positioning slot;

a plurality of terminals arranged into two rows and received in the insulated housing, respectively adapted for electrically connecting with the printed circuit board of the complementary connector;

a metal shell comprising a front side, a rear side and a pair of transversal sides joining to the front and the rear sides to define a receiving space;

the lower section of the receiving space of the metal shell housing the insulated housing and the upper section of the receiving space adapted for receiving the complementary connector; and the insulated housing pre-assembled with the metal shell together via a coupling device, with the bottom edge of the transversal side of the metal shell sandwiched in the positioning slot.

2. The electrical connector as claimed in claim 1, wherein the insulated housing has at least one protruding member formed on the lateral wall and the metal shell defines corresponding locking hole on the transversal side, wherein the protruding member latches with the locking hole to together define the coupling device, and wherein the coupling device further helps the insulated housing and the metal shell withstanding a bigger force along a vertical direction.

3. The electrical connector as claimed in claim 1, wherein the metal shell has two pairs of first legs respectively extending downwardly from the bottom of the two transversal sides, and wherein the pair of first legs matching with corresponding L-shaped bulge together help the metal shell and the insulated housing withstanding a bigger force along a longitudinal direction.

4. The electrical connector as claimed in claim 1, wherein the metal shell forms two pair of second legs respectively extending downwardly from lateral bottom of the transversal sides.

5. The electrical connector as claimed in claim 1, wherein the front side of the metal shell defines a pair of latching holes on the upper portion adapted for locking with a latching portion of the complementary connector.

6. The electrical connector as claimed in claim 1, wherein the metal shell defines a spring member formed at the bottom edge of the front side and curved toward the rear side.

7. The electrical connector as claimed in claim 1, wherein each of the transversal sides defines at least one cutout on the upper portion for mating with corresponding alignment member of the complementary connector.

8. The electrical connector as claimed in claim 1, wherein both the front wall and the back wall of the insulated housing define a plurality of slots communicating with the hollow, and wherein two rows of terminals are respectively received in the slots of the front and back walls.

9. The electrical connector as claimed in claim 8, wherein either the slots of the front wall or the slots of the back wall is aligned in a row along first direction perpendicular to a vertical direction.

10. The electrical connector as claimed in claim 8, wherein the bottom wall defines a plurality of passages separated into the first rows and the second rows along a horizontal direction, and wherein the terminals are assembled to the insulated housing from the passages into the slots.

11. The electrical connector as claimed in claim 10, wherein the first row of passages are staggered with the second row of passages.

12. The electrical connector as claimed in claim 1, wherein the terminals have same structures and are separated into the first and the second rows, and wherein either the first or second row of terminals are disposed along a horizontal direction.

13. The electrical connector as claimed in claim 1, wherein each of the terminals comprises a body portion, a contacting portion formed at the top end of the body portion, a rear portion formed at the bottom end of the body portion and a retention portion formed on the lower portion of the body portion, and wherein the retention portion defines a through hole thereon and a barb extending upwardly therefrom.

14. The electrical connector as claimed in claim 13, wherein the terminals are assembled to the insulated housing along a first direction, and wherein the barbs are interferentially combined with the bottom wall of the insulated housing.

15. An electrical connector assembly comprising:

a printed circuit board;

an insulative housing standing on the printed circuit board and defining two opposite end walls in a longitudinal direction and two opposite side walls in a transverse direction perpendicular to said longitudinal direction;

a central slot defined in the housing along said longitudinal direction with a plurality of slots communicatively located by two sides thereof;

a plurality of contacts disposed in the corresponding slots, respectively, each having a contacting section extending into the central slot and a mounting section mounted to the printed circuit board; and a frame like metallic shell standing upon the printed circuit board and enclosing said housing, said shell defining two transversely extending short faces latchably abutting against the corresponding opposite end walls of the housing in said longitudinal direction, and two longitudinally extending long face; wherein one of said two long faces is transversely spaced from the corresponding one of the two side walls of the housing with a first distance, while the other of said two long faces is transversely spaced from the other of said two side waits with a second distance larger than the first distance, under a condition of said other long face being equipped with a spring member extending inwardly toward the housing so as to cooperate with the corresponding side wall for sandwiching a planar protruding member of a complementary connector therebetween.

16. The assembly as claimed in claim 15, wherein one of said housing and said shell defines an opening, and the other defines a protrusion snugly received in the opening so as to assure no relative movement between the housing and the shell along the transversal direction or a vertical direction which is perpendicular to both said longitudinal direction and the transverse direction.

17. An electrical connector assembly comprising:

a printed circuit board;

an insulative housing standing on the printed circuit board and defining two opposite end walls in a longitudinal direction and two opposite side walls in a transverse direction perpendicular to said longitudinal direction;

a central slot defined in the housing along said longitudinal direction with a plurality of slots communicatively located by two sides thereof;

a plurality of contacts disposed in the corresponding slots, respectively, each having a contacting section extending into the central slot and a mounting section mounted to the printed circuit board; and a frame like metallic shell standing upon the printed circuit board and enclosing said housing, said shell defining two transversely extending short faces latchably abutting against the corresponding opposite end walls of the housing in said longitudinal direction, and two longitudinally extending long faces;

the central slot defining a first rectangular upper opening at an upper edge region, and the shell defining a second upper opening at a top edge region; wherein a longitudinal center line of said first rectangular upper opening is offset away from another longitudinal center line of the second rectangular upper opening toward one of said two side walls, under a condition that said one of said two side walls is equipped with a spring member so as to cooperate with said one of the two side walls for sandwiching a protruding member of a complementary connector therebetween.

18. The assembly as claimed in claim 17, wherein one of said housing and said shell defines an opening, and the other defines a protrusion snugly received in the opening so as to assure no relative movement between the housing and the shell along the transversal direction or a vertical direction which is perpendicular to both said longitudinal direction and the transverse direction.

19. The assembly as claimed in claim 17, wherein the shell is provided with a plurality of mounting legs on each of the short faces, and said mounting legs are arranged in an asymmetrical manner with regard to the longitudinal central line of the housing.

* * * * *